US005107657A

United States Patent [19]

Diehl et al.

[11] Patent Number: 5,107,657

[45] Date of Patent: Apr. 28, 1992

[54] WRAPPING APPARATUS AND RELATED WRAPPING METHODS

[75] Inventors: Werner K. Diehl, Coral Springs, Fla.; Roy Salzsauler, Georgetown, Canada

[73] Assignee: Mima Incorporated A Corporation of DE, Glenview, Ill.

[21] Appl. No.: 693,676

[22] Filed: Apr. 30, 1991

[51] Int. Cl.[5] ..... B65B 13/04

[52] U.S. Cl. ..... 53/141; 53/556; 53/588; 53/389.2

[58] Field of Search ..... 53/141, 399, 441, 556, 53/587, 588, 389.2, 389.4; 100/13, 15

[56] References Cited

U.S. PATENT DOCUMENTS

| | | | |
|---|---|---|---|
| 4,255,918 | 3/1981 | Lancaster | 53/556 |
| 4,418,510 | 12/1983 | Lancaster | 53/399 X |
| 4,432,185 | 2/1984 | Geisinger | 53/587 X |
| 4,807,427 | 2/1989 | Casteel | 53/587 X |
| 4,938,008 | 7/1990 | Salzsauler | 53/556 |

*Primary Examiner*—John Sipos

*Attorney, Agent, or Firm*—T. W. Buckman; D. J. Breh

[57] ABSTRACT

Apparatus for wrapping a pallet load with a wrapping film applied selectively as a film rope or as a film sheet. The load is supported in an elevated position. A rotary arm supported above the load is arranged to be rotatably driven. An upright member depending from the rotary arm is spaced outwardly from the load in any rotary arm position. A carriage is arranged to be upwardly and downwardly driven along such member. A dispenser on the carriage dispenses the wrapper as a rope or as a sheet. A guide, which comprises a lever and a hook on the lever, is moveable among extended, partly retracted, and fully retracted positions. In the extended position, the guide guides the rope across the respective corners of the load. In the partly retracted position, the guide does not interfere with driving the carriage along the upright member.

9 Claims, 6 Drawing Sheets

ROPE DIAGONALS AND ROPE WRAPS

SHEET WRAPS

WRAPPING APPARATUS AND RELATED WRAPPING METHODS

TECHNICAL FIELD OF THE INVENTION

This invention pertains to an apparatus and related methods for wrapping a load having upper edges and lower edges, such as a pallet load, boxes stacked on a slip sheet, or a shipping crate, with a wrapping film, which is applicable as a film rope. The apparatus comprises a novel guide, which guides the film rope across the upper and lower edges of the load.

BACKGROUND OF THE INVENTION

An apparatus of a known type for wrapping such o a load is exemplified in Salzsauler U.S. Pat. Nos. 4,934,123 and 4,938,008. In such an apparatus, the load is supported in an elevated position, in which each of its upper and lower corners is exposed. A rotary arm, which is supported by fixed structure above the pallet load, is arranged to be rotatably driven about a vertical axis extending through the load. An upright leg depending from the arm sweeps a cylindrical path around the load as the arm rotates. A carriage is arranged to be upwardly and downwardly driven along the upright leg. Mechanisms on the carriage are arranged to dispense a wrapping film as a film sheet, in which the wrapping film remains substantially at full width, as the arm and the carriage are driven in a suitable manner. As the arm and the carriage are driven, the film sheet is wrapped around the load in spiral patterns, which may be upwardly or downwardly directed.

Furthermore, prior attempts have been made to adapt such an apparatus to dispensing a wrapping film selectively as a film rope, in which the wrapping film is bunched into a rope-like configuration, and as a film sheet, in which the wrapping film remains substantially at full width, and to wrapping such a load with the wrapping film as a film rope before wrapping the load with the wrapping film as a film sheet. However, those attempts have not been entirely satisfactory, since there was no suitable means for guiding a film rope across the upper and lower corners of such as load so as to enable the load to be diagonally or sinusoidally wrapped with the film rope.

Load-wrapping apparatus of related interest are disclosed in Lancaster et al. U.S. Pat. No. 4,418,510, Geisinger U.S. Pat. No. 4,432,185, and Geisinger U.S. Pat. No. 4,619,102.

It would be highly desirable to have loadwrapping apparatus capable of wrapping a load diagonally or sinusoidally with a film rope, which would not only tie the load but would also compress the load vertically, as well as horizontally. As compared to a film sheet of a given material, a film rope of the same material tends to be considerably stronger per unit wrapping area.

Thus, there has been a need, to which this invention is addressed, for improvements in an apparatus of the aforenoted type.

SUMMARY OF THE INVENTION

This invention provides improved apparatus and related methods for wrapping a load having an upper end and a lower end, such as a pallet load, a load of boxes stacked on a slip sheet, a load of stacked boxes of suitable sizes without a pallet or a slip sheet, or a shipping crate, with a wrapping film, which is applied as a film rope. As mentioned above, when a wrapping film is applied as a film rope, the wrapping film is bunched into a rope-like configuration. The improved apparatus comprises a novel guide, which guides the film rope across the upper and lower edges of the load.

The improved apparatus comprises a structure for supporting the load in an elevated position, in which each edge defined by the upper and lower ends of the load is exposed, and a structure in a fixed position above the load. A rotary arm is supported by the latter structure and is arranged to be rotatably driven about a vertical axis. The rotary arm is disposed above the load in any rotated position of the arm.

Moreover, in the improved apparatus, an upright member depends from the arm so as to be outwardly spaced from the load in any rotated position of the rotary arm. Also, a carriage mounted to the upright member is arranged to be selectively driven along the upright member, either in an upward direction or in a downward direction. Devices are provided for driving the rotary arm rotatably about the vertical axis in such manner that the upright member sweeps a cylindrical path around the load, for driving the carriage selectively in either direction along the upright member, and for dispensing a wrapping film from the carriage as a film rope.

According to this invention, the improved apparatus comprises a rope guide, which is moveable between an extended position and a retracted position. In the extended position, the rope guide guides the film rope above and across the upper end of the load and below and across the lower end of the load as the arm is driven rotatably with the carriage being held at stationary positions relative to the upright member. In the retracted position, the rope guide is disposed so as to avoid interference between the rope guide and the pallet load as the carriage is driven in either direction along the upright member. A device is provided for moving the rope guide selectively between the extended position and the retracted position.

Preferably, the rope guide comprises a lever and a hook, which is integral with the lever. The lever is mounted pivotally to the carriage between a first position corresponding to the extended position of the rope guide and a second position corresponding to the retracted position of the rope guide. The film rope passes through the hook as the film rope is dispensed by the dispensing device.

In a preferred construction, the hook is capable of performing important functions. In the preferred construction, upon pivotal movement of the lever from the fully retracted position into the partly retracted position after the wrapping film has been established as a film rope, the hook engages the film rope automatically. Also, upon pivotal movement of the lever in either direction between the partly retracted and fully extended positions, the hook retains the film rope R. Moreover, upon pivotal movement of the lever from the partly retracted position into the fully retracted position, the hook disengages the film rope R automatically.

The improved apparatus may be advantageously used for wrapping a pallet load, which is shaped generally as a rectangular solid having upper edges defining upper corners and lower edges defining lower corners, with a wrapping film, which is applied selectively as a film rope or as a film sheet. The dispensing device may be thus arranged for dispensing a wrapping film from the carriage selectively as a film rope or as a film sheet.

Moreover, if the rope guide comprises a lever and a hook, as described above, the improved apparatus may comprise a device for preventing the carriagedriving device from driving the carriage in either direction along the upright member whenever the lever is in the first position corresponding to the extended position of the rope guide.

In a preferred arrangement, the lever is pivotable selectively among a first, extended position, a second, partly retracted position, and a third, fully retracted position. In the fully retracted position, the lever and the hook are disposed so as to avoid interference with the wrapping film when the wrapping film is being dispensed as a film sheet.

These and other objects, features, and advantages of this invention are evident from the following description of a preferred embodiment of this invention with reference to the accompanying drawings.

DETAILED DESCRIPTION OF PREFERRED EMBODIMENT

Figure 1:
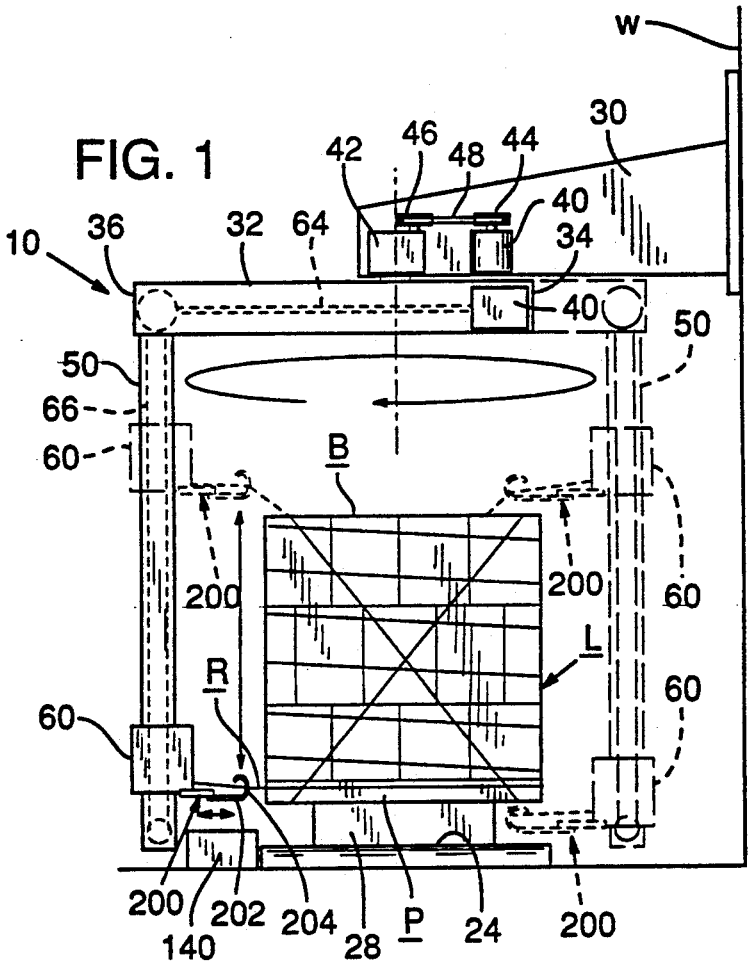
FIG. 1 is a largely diagrammatic, elevational view of an apparatus for wrapping a pallet load with a wrapping film, which may be selectively applied as a film rope or as a film sheet, and which is shown as a film rope.
Figure 3:
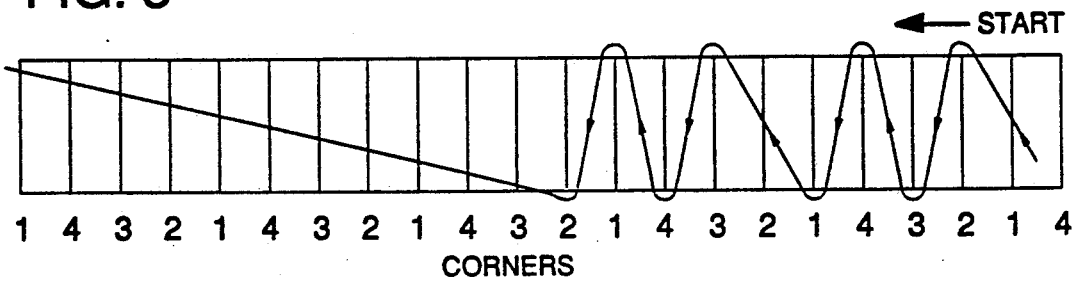
FIG. 3 is a diagrammatic development showing one possible pattern for wrapping the pallet load with the film rope.

As shown in FIG. 1 and elsewhere in the drawings, an apparatus 10 for wrapping a load with a wrapping film constitutes a preferred embodiment of this invention. The apparatus 10 is an improved version of the apparatus disclosed in Salzsauler U.S. Pat. Nos. 4,934,123 and No. 4,938,008, the disclosures of which are incorporated herein by reference. The apparatus 10 comprises a film-cutting and heat-sealing mechanism to be later described, which is similar to the film-cutting and heat-sealing mechanism disclosed in Diehl U.S. patent application Ser. No. 07/636,485 filed Dec. 31, 1990, and assigned commonly herewith, the disclosure of which is incorporated herein by reference. The apparatus 10 differs from the apparatus disclosed in the Salzsauler patents noted above, and from the apparatus disclosed in the Diehl patent application noted above, by comprising a rope guide to be later described. The rope guide facilitates applying the wrapping film as a film rope, in which the wrapping film is bunched into a rope-like configuration, by guiding the film rope across upper and lower surfaces of the load.

As shown in the drawings, the load is a pallet load L, which comprises plural boxes B stacked on a pallet P. It is possible to substitute a slip sheet (not shown) for the pallet P. The apparatus 10 may be alternatively used with a load (not shown) having different characteristics, such as stacked boxes without a pallet or a slip sheet beneath such boxes, or a shipping crate, which does not require a pallet or a slip sheet. As shown in the drawings, the load L is shaped generally as a rectangular solid having six mutually orthogonal faces, which define four upper corners and four lower corners. In FIGS. 2A, 2B, 2C, and 3, the generally vertical edges of the load L are numbered 1, 2, 3, and 4 respectively.

As shown in FIGS. 1 and 2, the apparatus 10 comprises a roller conveyor 20 having an inlet portion 22, a middle portion 24, and an outlet portion 26. The middle portion 24 comprises a platform 28, which is adapted to support the load L, and which is arranged to be selectively elevated or lowered. The platform 28 has an upper surface smaller than the lower surface of the load L. In FIG. 1, the platform 28 is shown in an elevated position, in which the platform 28 supports the load L in an elevated position so that all upper and lower corners of the load L are exposed. The roller conveyor 20 comprises known means (not shown) for selectively elevating and lowering the platform 28 with the load L supported on the platform 28.

The apparatus 10 comprises a supporting structure 30, which is disposed in a fixed position above the load L. As shown in FIG. 1, the supporting structure 30 is mounted to a wall W, such as a building wall or a free-standing support. A rotary arm 32 having a proximal end 34 and a distal end 36 is supported by and beneath the supporting structure 30, near the proximal end 34, and is arranged to be rotatably driven about a vertical axis. The rotary arm 32 is disposed above the load L in any rotated position of the arm 32.

A motor 40, which is mounted to the supporting structure 30, and a gear reducer 42, which also is mounted thereto and which is arranged to drive the arm 32 directly, are arranged to drive the arm 32, via a pulley 44 driven by the motor 40, a pulley 46 arranged to drive the arm 32, and an endless belt 48 connecting the pulleys 44, 46, in a manner disclosed in Salzsauler U.S. Pat. No. 4,938,008, supra. A hollow, upright member 50, which depends from the distal end 36 of the rotary arm 32, sweeps a cylindrical path around the load L as the rotary arm 32 rotates. A carriage 60, which is mounted to the upright member 50, is arranged to be selectively driven along the upright member 50, either in an upward direction or in a downward direction. A motor 62, which is carried by the rotary arm 32, is arranged to drive the carriage 60 upwardly or downwardly along the upright member 50, via a drive shaft 64 and an endless chain 66, in a manner disclosed in Salzsauler U.S. Pat. No. 4,938,008, supra.

The carriage 60 is similar in many respects to the carriage disclosed in Salzsauler U.S. Pat. No. 4,934,123, supra. Thus, the carriage 60 comprises opposite mounts 70, 72, which are arranged to hold a roll of wrapping film F, such as so-called "stretch" film. Also, the carriage 60 is arranged to feed the wrapping film F from the roll successively around a direction-changing roller 74, around a pair of prestretching rollers 76, 78, which operate in a known manner, around a roller 80 on a dancer bar, which operates in a known manner, and around a directionchanging roller 84, so as to dispense the wrapping film F either as a film rope R or as a film sheet S.

Figure 4:
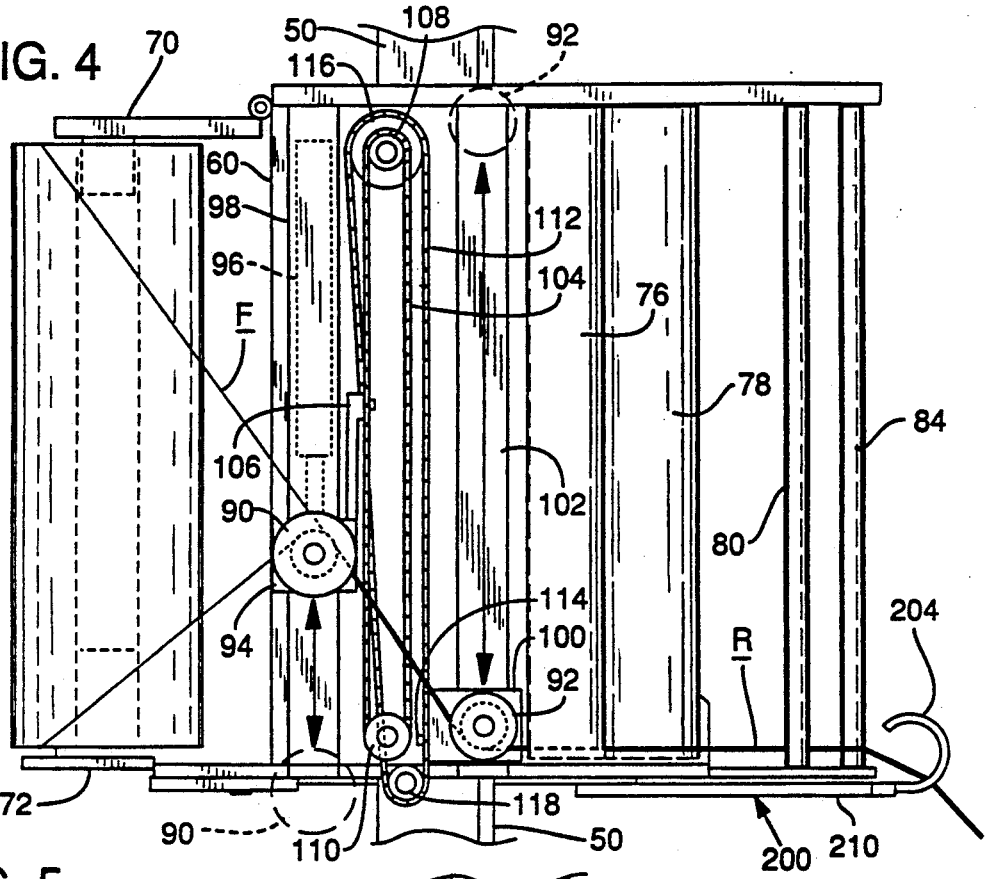
FIG. 4 is a largely diagrammatic, elevational view of a carriage of the same apparatus, as taken from a side showing mechanisms for bunching the wrapping film into the film rope.
Figure 5:
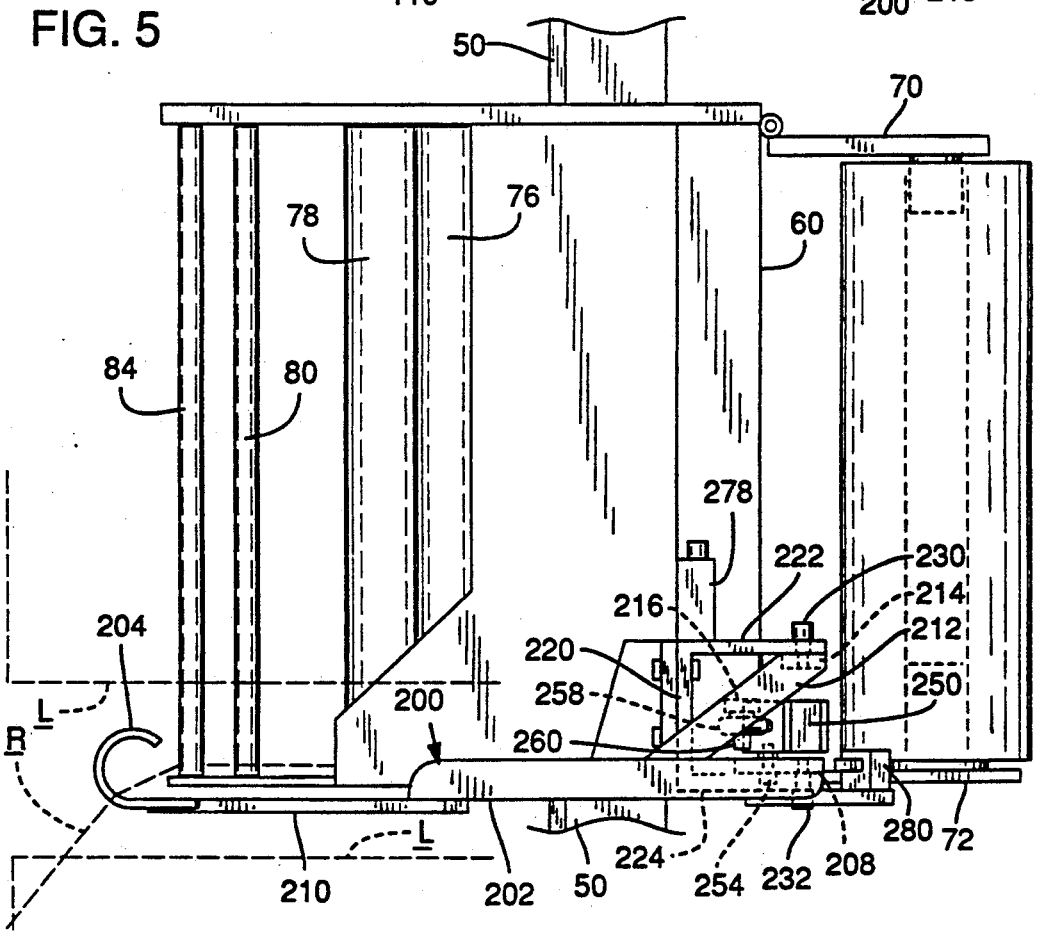
FIG. 5 is a largely diagrammatic, elevational view of the same carriage, as taken from a side showing a rope guide and related devices.

As shown in FIG. 4, the carriage 60 comprises a pair of film-roping sheaves 90, 92. The sheaves 90, 92, are arranged so that, as the wrapping film F is dispensed from the roll, the lower edge of the wrapping film F engages the sheave 90 and the upper edge of the wrapping film F engages the sheave 92. The sheaves 90, 92, are moveable selectively to allow the wrapping film F to be normally dispensed from the roll as a film sheet S having a substantially full width or to bunch the wrapping film F into a film rope R having a substantially rope-like configuration.

The sheave 90 is mounted rotatably to a bracket 94, which is moveable conjointly with the piston of a double-acting, pneumatic, piston-cylinder mechanism 96, along a vertical member 98. Thus, the sheave 90 is moveable between a lower position, in which it is shown in broken lines in FIG. 4, and an upper position, in which it is shown in full lines therein, over a range indicated by a relatively short, double-headed arrow in FIG. 4. The sheave 92 is mounted rotatably to a bracket 100, which is mounted moveably on a vertical member 102. Thus, the sheave 92 is moveable between a lower position, in which it is shown in full lines in FIG. 4, and an upper position, in which it is shown in broken lines therein, over a range indicated by a relatively long, double-headed arrow in FIG. 4.

The bracket 100 mounting the sheave 90 is connected to an endless chain 104, via a link 106, for conjoint movement with the endless chain 104 between the upper and lower positions of the sheave 90. The endless chain 104 is deployed around a relatively small, upper sprocket wheel 108 and around a relatively small, lower sprocket wheel 110. The bracket 94 mounting the sheave 92 is connected to an endless chain 112, via a link 114, for conjoint movement with the endless chain 112. The endless chain 112 is deployed around a relatively large, upper sprocket wheel 116 and around a relatively small, lower sprocket wheel 118. The upper sprocket wheels 108, 116, are mounted to the carriage 60 for conjoint rotation about a common axis. The lower sprocket wheels 110, 118, are mounted to the carriage 60 for rotation of each about its own axis.

In a sheet-wrapping mode, the piston-cylinder mechanism 96 is actuated in a forward direction so as to move the sheave 90 to its lower position and so as to move the sheave 92 to its upper position, whereby the wrapping film F is dispensed as a film sheet S. In a rope-wrapping mode, the piston-cylinder mechanism 96 is actuated in a reverse direction so as to move the sheave 90 to its upper position and so as to move the sheave 92 to its lower position, whereby the wrapping film F is dispensed as a film rope R.

Figure 2A:
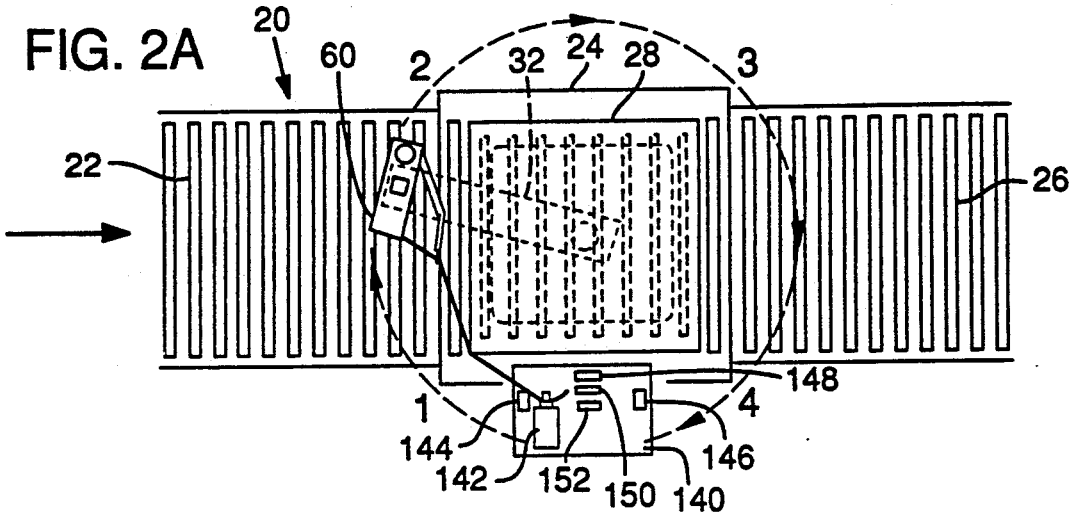
FIGS. 2A. 2B, and 2C are largely diagrammatic, plan views of the same apparatus at various stages in its operation.
Figure 2B:
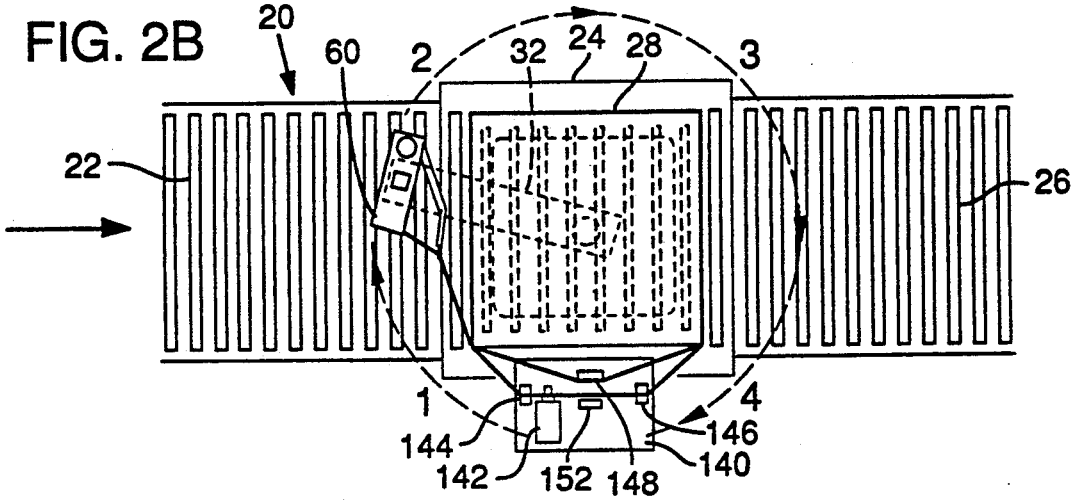
Figure 2C:
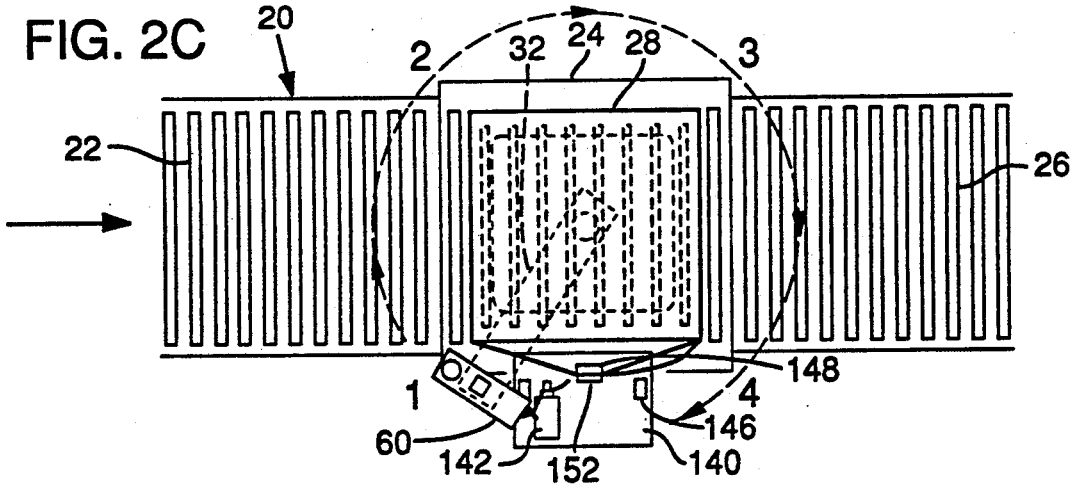

A film-cutting and heat-sealing mechanism 140 is provided, which is similar to the film-cutting and heat-sealing mechanism disclosed in Diehl U.S. patent application Ser. No, 07/636,485, supra. As shown in FIGS. 2A, 2B, and 2C, the mechanism 140 comprises a clamping and cutting device 142, which is used to clamp a free end of the wrapping film F at the beginning of a wrapping cycle and at the conclusion of the wrapping cycle, and which is used to cut off the final layer of the wrapping film F at the conclusion of the wrapping cycle. Also, the mechanism 140 comprises a pair of film guides 144, 146, which are used to grasp the next-to-final and final layers of the wrapping film F, as a film rope R, before such layers are heat-sealed to each other and before the final layer is cut off. Moreover, the mechanism 140 comprises an anvil 148, against which such layers are disposed when heat-sealed to each other, a heating bar 150 for heating such layers so as to weld such layers, and a pressing bar 152 for pressing the heated layers against each other and against the anvil 148. Further details of the mechanism 140 and its operation are found in the Diehl patent application noted above. Its usage in the apparatus 10 is explained hereinafter.

Figure 6:
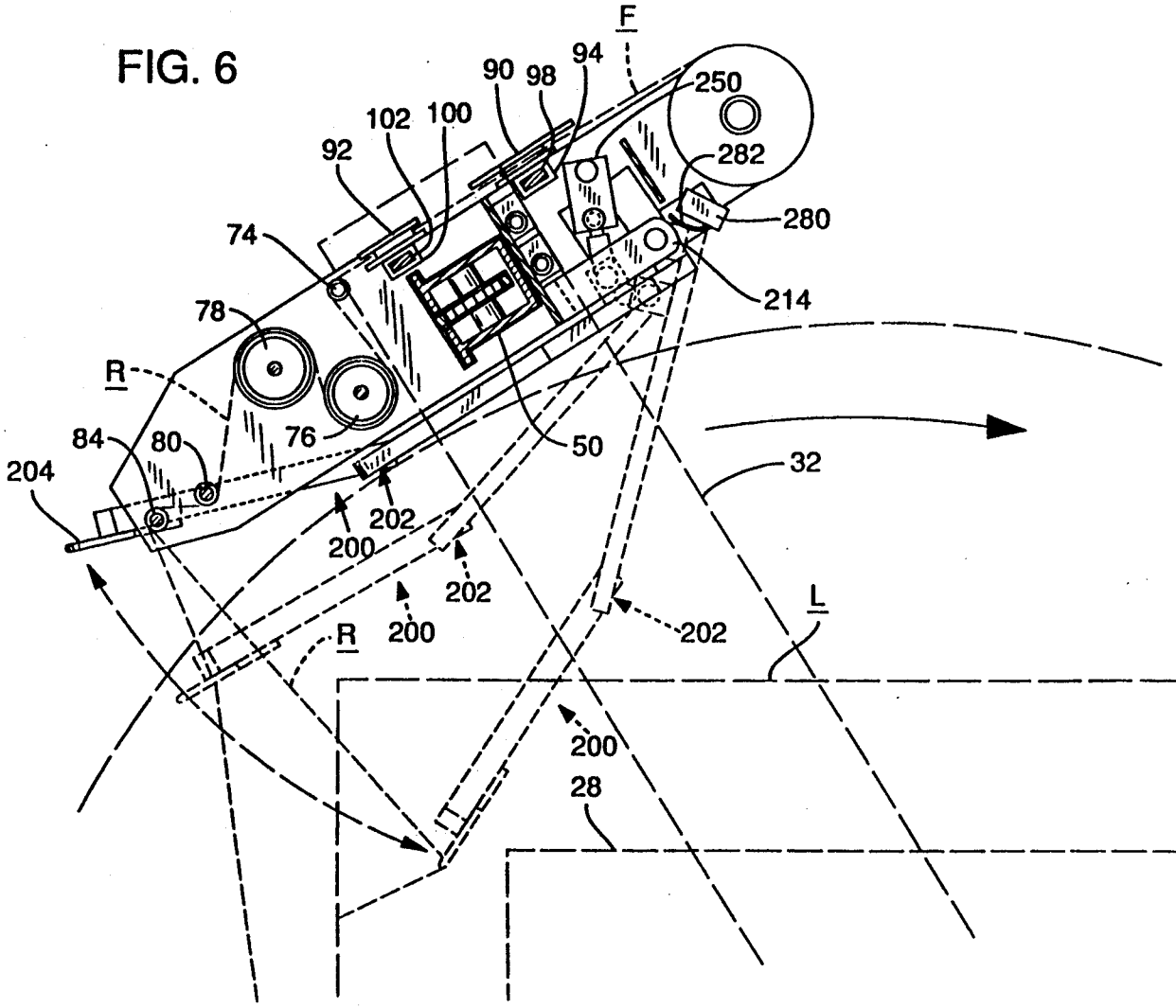
FIG. 6 is a largely diagrammatic, plan view of the same carriage with the rope guide being shown in three different positions in full and broken lines, and with portions of the pallet load and an underlying support being shown in broken lines.
Figure 6A:
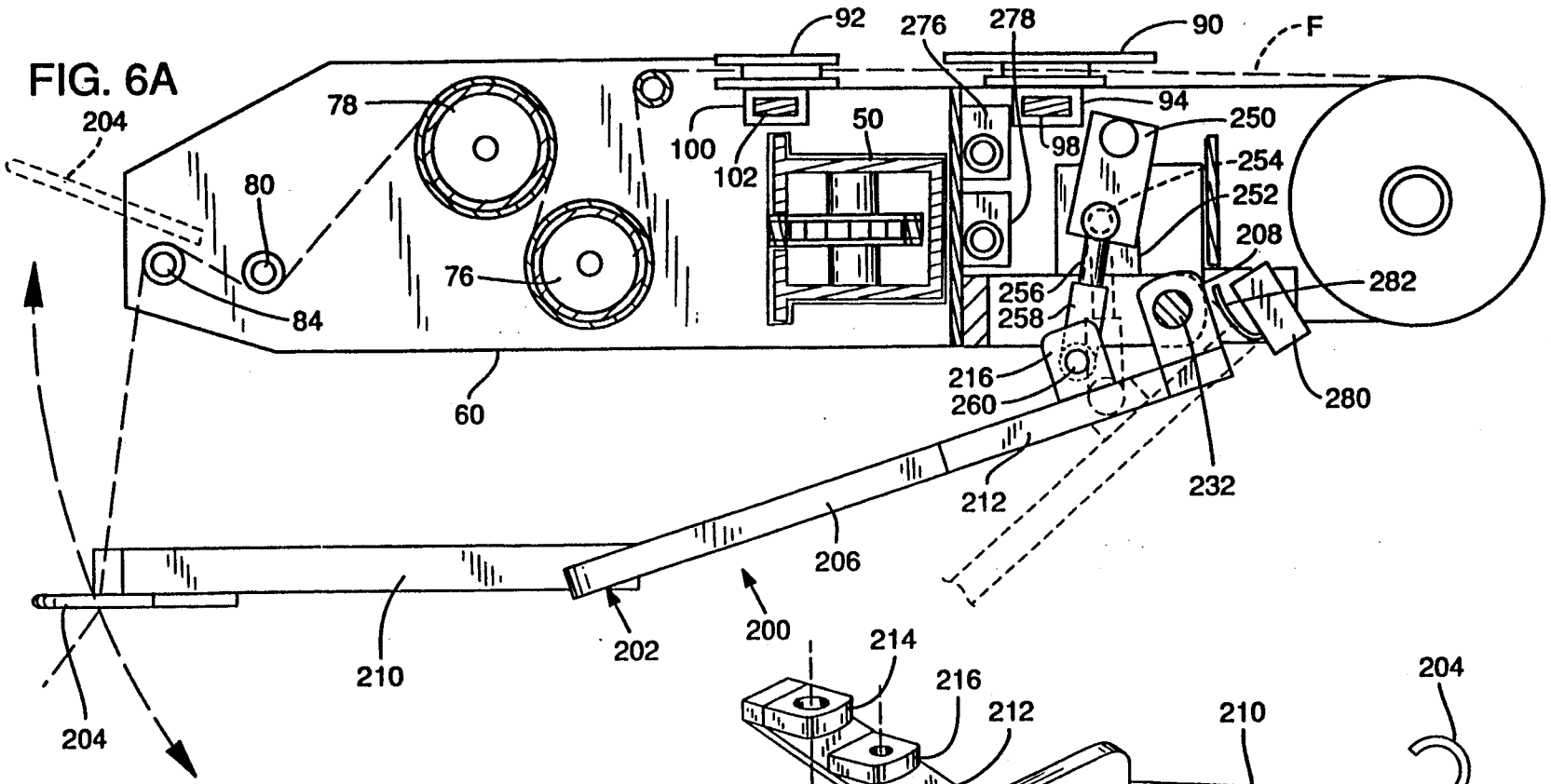
FIG. 6A is an enlarged detail taken substantially from FIG. 6 with some features sectioned differently.
Figure 6B:
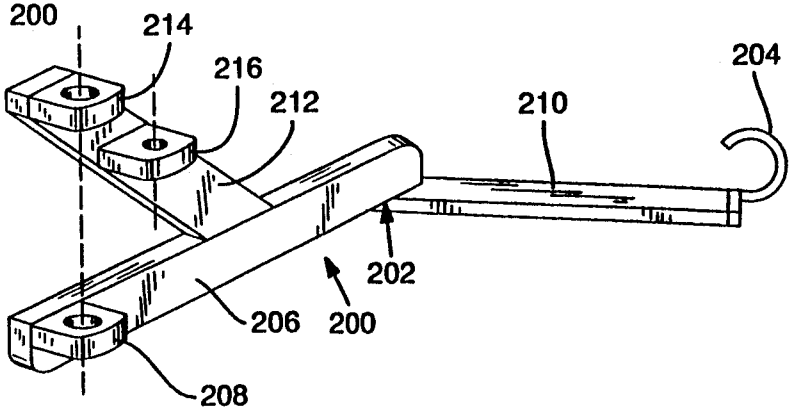
FIG. 6B is a perspective view of the rope guide removed from the apparatus.
Figure 8:
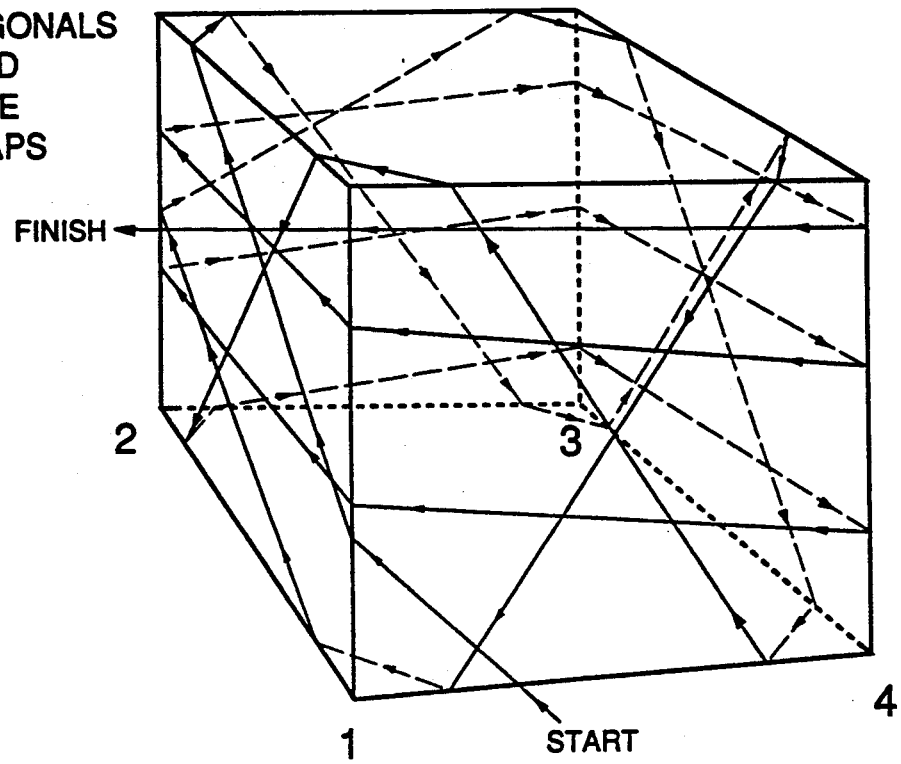
FIG. 8 is a diagrammatic representation of the film rope, as wrapped around the pallet load in one possible pattern before the pallet load is wrapped with a film sheet.
Figure 9:
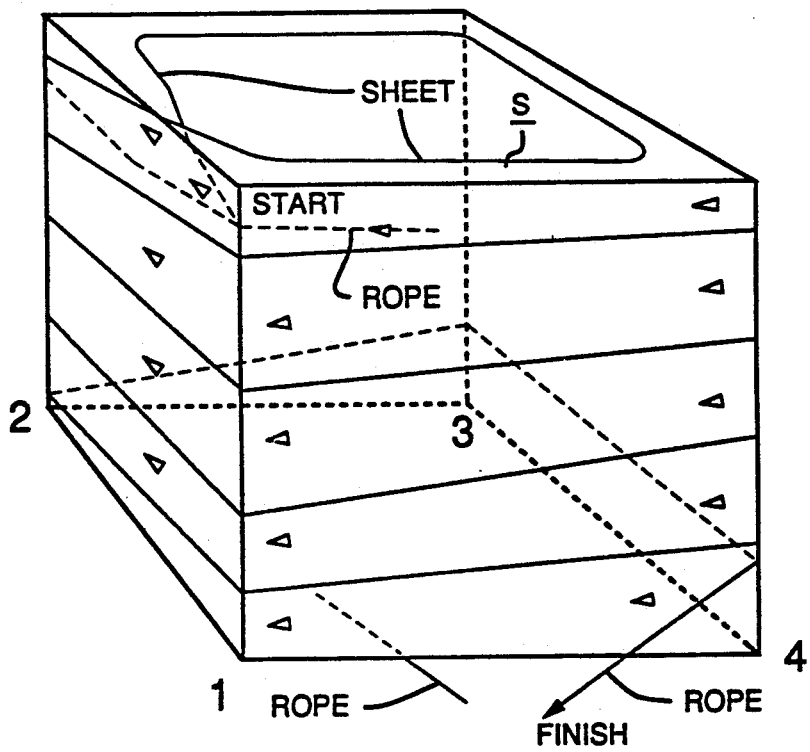
FIG. 9 is a diagrammatic representation of a film sheet, as wrapped around the pallet load in one possible pattern after the pallet load has been wrapped with the film rope.

According to this invention, the apparatus comprises a rope guide 200, which is moveable among three positions, as shown in FIG. 6. In a first, extended position, in which the rope guide 200 is shown in broken lines in FIG. 6, the rope guide 200 guides the wrapping film F, as the film rope R, across the upper and lower corners of the load L as the rotary arm 32 is driven rotatably with the carriage 60 held at suitable positions along the upright member 50. In a second, partly retracted position, in which the rope guide 200 also is shown in broken lines in FIG. 6, the rope guide 200 is disposed so as to avoid interference between the rope guide 200 and the load L as the carriage 60 is driven upwardly or downwardly along the upright member 50. In a third, fully retracted position, the rope guide 200 is disposed so as to avoid interference with the film sheet S as the film sheet S is dispensed by the aforenoted rollers on the carriage 60.

As shown in FIGS. 5, 6, 6A, and 6B and elsewhere in the drawings, the rope guide 200 comprises a lever 202 and a hook 204, which is integral with the lever 202. The lever 202 comprises a first bar 206, a tab 208 welded to a proximal end of the first bar 206, and a second bar 210 welded to a distal end of the first bar 206 at a proximal end of the second bar 210. The hook 204 is bolted to a distal end of the second bar 210 is curved upwardly and backwardly, as shown, so as to conform generally to a circular arc of about 220° to about 230°. A brace 212 is welded to the first bar 206, at a lower end of the brace 212, so as to extend upwardly and backwardly. A tab 214, which is spaced above the tab 208, is welded to an upper end of the brace 212. A tab 216 is welded to the brace 212 at a midportion of the brace 212.

A generally C-shaped bracket 220 having an upper arm 222 and a lower arm 224 parallel to the upper arm 222 is bolted to the carriage 60. The rope guide 200 is mounted pivotally to the carriage 60 for pivotal movement about a generally vertical axis among the first, second, and third positions noted above, via a pivot pin 230 extending through suitable apertures in the tab 214 and in the upper arm 222, and via a pivot pin 232 extending through suitable apertures in the tab 208 and in the lower arm 224.

The curvature and placement of the hook 204 enable the hook 204 to perform important functions. Upon pivotal movement of the lever 202 from the fully retracted position into the partly retracted position after the wrapping film W has been established as a film rope R, the hook 204 engages the film rope automatically. Upon pivotal movement of the lever 202 in either direction between the partly retracted and fully extended positions, the hook 204 retains the film rope R. Upon pivotal movement of the lever 202 from the partly retracted position into the fully retracted position, the hook 204 disengages the film rope R automatically.

A double-acting, pneumatic, piston-cylinder mechanism 250 is mounted pivotally to a plate 252, which is welded to the bracket 220, via a pivot pin 254. A piston of the mechanism 250 is connected to the tab 216, via a piston rod 256 of the mechanism 250, a link 258 fixed to the piston rod 256, and a pivot pin 260, which passes through suitable apertures in the link 258 and in the tab 216. Thus, when the piston 256 is advanced, the rope guide 200 is pivoted toward its extended position. Also, when the piston 256 is retracted, the rope guide 200 is pivoted oppositely.

Figure 7:
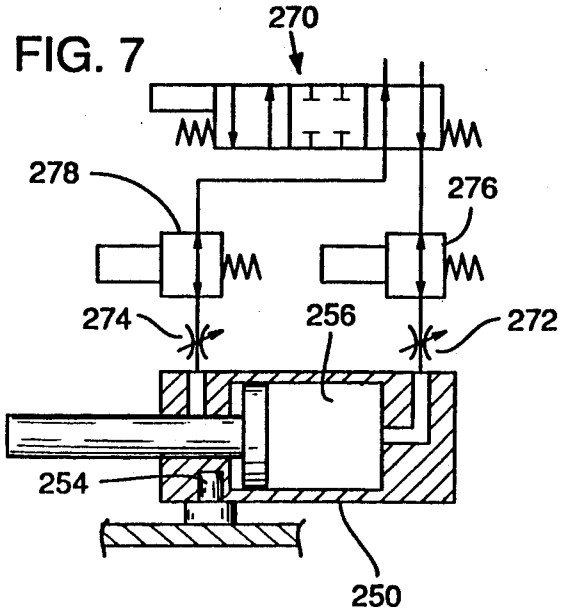
FIG. 7 is a schematic diagram showing certain pneumatic valves of the apparatus.

As shown in FIG. 7, the mechanism 250 is arranged to be selectively actuated, via a doubleacting, solenoid-actuated, three-position, pneumatic valve 270, which is connected to a source (not shown) of pressurized air. The valve 270 is switchable from a center (standby) position, in which all ports of the valve 270 are blocked, either to a piston-advancing position, in which the valve 270 is shown in FIG. 7, or to a piston-retracting position. In the pistonadvancing position, the valve 270 allows air pressure to advance the piston 256 of the mechanism 250. In the piston-retracting position, the valve 270 allows air pressure to retract the piston 256. Similar pneumatic flow restrictors 272, 274, are connected between the valve 270 and the opposite ends of the mechanism 250 so as to prevent rapid acceleration or deceleration of the piston 256. As shown in FIG. 7, a solenoid-actuated, normally open, pneumatic valve 276 is connected between the flow restrictor 272 and the valve 270, and a solenoid-actuated, normally open, pneumatic valve 278 is connected between the flow restrictor 274 and the valve 270. When closed, the valve 276 blocks air discharge from the mechanism 250 so as to prevent the piston 256 from retracting further. When closed, the valve 278 blocks air discharge from the mechanism 250 so as to prevent the piston from advancing further.

A limit switch 280 having an actuating lever 282 is mounted operatively on the carriage in a position where the actuating lever 282 is engaged when the rope guide 200 is pivoted from the first, extended position into the second, partly retracted position and where the actuating lever 282 is disengaged when the rope guide 200 is pivoted from the third, fully retracted position past the second, partly retracted position. The limit switch 280 is used to control the solenoid-actuated valves 276, 278, as discussed below. Also, the limit switch 280 is used to disable the motor 62 so as to prevent the carriage 60 from being moved upwardly or downwardly along the upright member 50 whenever the rope guide 200 is pivoted to the extended position, either above or below the load L.

All operations of the apparatus 10 may be computer-controlled. A typical sequence of such operations is to be next described.

Initially, the film-roping sheaves 90, 92, are moved, via the piston-cylinder mechanism 96, so as to establish the wrapping film F as a film rope R. A free end of the film rope R is held by the film-cutting and heat-sealing mechanism 140. The load L is centered on the platform 28, which is elevated so as to expose all upper and lower corners of the load L. The film rope R is deployed through the hook 204 of the rope guide 200, which is pivoted to the partly retracted position, via the valve 270, the valve 278, and the limit switch 280. Thereupon, a wrapping cycle is performed, as shown in FIGS. 2A, 2B, 2C, 3, 8, and 9.

As the wrapping cycle begins, the carriage 60 is moved upwardly on the upright member 50 and the rotary arm 32 is rotated simultaneously, whereby the film rope R is wrapped initially around the load edge 1 at a midpoint of the load edge 1 and along an upper part of the load face between the load edge 1 and the load edge 2.

When the film rope R passes above the load L, the rope guide 200 is pivoted to its fully extended position, in which the rope guide 200 remains as the film rope R is wrapped above and across the upper corner including the load edge 2, upon further rotation of the rotary arm 32 as the carriage 60 is held in a stationary position relative to the upright member 50. Thereupon, the rope guide 200 is pivoted to its partly retracted position, whereupon the carriage 60 is moved downwardly along the upright member 50 as the rotary arm 32 is rotated simultaneously, whereby the film rope R is wrapped along the load face between the load edge 2 and the load edge 3.

When the film rope R passes below the load L, the rope guide 200 is pivoted to its fully extended position, in which the rope guide 200 remains as the film rope R is wrapped below and across the lower corner including the load edge 3, upon further rotation of the rotary arm 32 as the carriage 60 is held in a stationary position relative to the upright member 50. Thereupon, the rope guide 200 is pivoted to its partly retracted position, whereupon the carriage 60 is moved upwardly along the upright member 50 as the rotary arm 32 is rotated simultaneously, whereby the film rope R is wrapped along the load face between the load edge 3 and the load edge 4.

When the film rope R passes above the load L, the rope guide 200 is pivoted to its fully extended position, in which the rope guide 200 remains as the film rope R is wrapped above and across the upper corner including the load edge 4, upon further rotation of the rotary arm 32 as the carriage 60 is held in a stationary position relative to the upright member 50. Thereupon, the rope guide 200 is pivoted to its partly retracted position, whereupon the carriage 60 is moved downwardly along the upright member 50 as the rotary arm 32 is rotated simultaneously, whereby the film rope R is wrapped along the load face between the load edge 4 and the load edge 1.

When the film rope R passes below the load L, the rope guide 200 is pivoted to its fully extended position, in which the rope guide 200 remains as the film rope R is wrapped below and across the lower corner including the load edge 1, upon further rotation of the rotary arm 32 as the carriage 60 is held in a stationary position relative to the upright member 50. Thereupon, the rope guide 200 is pivoted to its partly retracted position, whereupon the carriage 60 is moved upwardly along the upright member 50 as the rotary arm 32 is rotated simultaneously, whereby the film rope R is wrapped along a lower part of the load face between the load edge 1 and the load edge 2, around the load edge 2 at a location between the upper and lower corners including the load edge 2, and along an upper part of the load face between the load edge 2 and the load edge 3.

When the film rope R passes above the load L, the rope guide 200 is pivoted to its fully extended position, in which the rope guide 200 remains as the film rope R is wrapped above and across the upper corner including the load edge 3, upon further rotation of the rotary arm 32 as the carriage 60 is held in a stationary position relative to the upright member 50. Thereupon, the rope guide 200 is pivoted to its partly retracted position, whereupon the carriage 60 is moved downwardly along the upright member 50 as the rotary arm 32 is rotated simultaneously, whereby the film rope R is wrapped along the load face between the load edge 3 and the load edge 4.

When the film rope R passes below the load L, the rope guide 200 is pivoted to its fully extended position, in which the rope guide 200 remains as the film rope is wrapped below and across the lower corner including the load edge 4, upon further rotation of the rotary arm 32 as the carriage 60 is held in a stationary position relative to the upright member 50. Thereupon, the rope guide 200 is pivoted to its partly retracted position, whereupon the carriage 60 is moved upwardly along the upright member 50 as the rotary arm 32 is rotated simultaneously, whereby the film rope R is wrapped along the load face between the load edge 4 and the load edge 1.

When the film rope R passes above the load L, the rope guide 200 is pivoted to its fully extended position, in which the rope guide 200 remains as the film rope R is wrapped above and across the upper corner including the load edge 1, upon further rotation of the rotary arm 32 as the carriage 60 is held in a stationary position relative to the upright member 50. Thereupon, the rope guide 200 is pivoted to its partly retracted position, whereupon the carriage 60 is moved downwardly along the upright member 50 as the rotary arm 32 is rotated simultaneously, whereby the film rope R is wrapped along the load face between the load edge 1 and the load edge 2.

When the film rope R passes below the load L, the rope guide 200 is pivoted to its fully extended position, in which the rope guide 200 remains as the film rope R is wrapped below and across the lower corner including the load edge 4, upon further rotation of the rotary arm 32 as the carriage 60 is held in a stationary position relative to the upright member 50. Thereupon, the rope guide 200 is pivoted to its partly retracted position, whereupon the carriage 60 is moved upwardly (at a relatively slow rate) along the upright member 50 as the rotary arm 32 is rotated simultaneously, whereby the film rope R is wrapped in a upwardly directed, spiral pattern around eleven successive load faces starting with the load face between the load edge 2 and the load edge 3 and ending with the load face between the load edge 4 and the load edge 1.

Subsequently, the film-roping sheaves 90, 92, are moved, via the piston-cylinder mechanism 96, so as to reestablish the wrapping film F as a film sheet S. Thereupon, after the free end of the film rope R is released by the film-cutting and heat-sealing mechanism 140, the carriage 60 is moved downwardly (at a similarly slow rate) along the upright member 50 as the rotary arm 32 is rotated simultaneously, whereby the film sheet S is wrapped in a downwardly directed pattern around eleven successive load faces starting with the load face between the load edge 1 and the load edge 2 and ending with the load face between the load edge 4 and the load edge 1, and whereby the free end released by the mechanism 140 is wrapped by the film sheet S. Thereupon, the film-roping sheaves 90, 92, are moved, via the piston-cylinder mechanism 96, so as to reestablish the wrapping film F as a film rope R, whereupon the film-cutting and heat-sealing mechanism 140 is operated in the manner disclosed in the Diehl patent application, supra, so as to heat seal and cut off the film rope R. Generally, the film rope R is wrapped around the load L in two successive layers, the outer layer being engaged by the film guides 144, 146, as shown in FIG. 2B, whereupon the outer layer is heat-sealed to the inner layer and is cut off by the mechanism 140, as shown in FIG. 2C.

It may be thus seen that the rope guide 200 enables the apparatus 10 to wrap the load L diagonally or sinusoidally with the wrapping film F, as a film rope R, which not only ties the load L but also compresses the load L vertically, as well as horizontally. The apparatus 10 is capable, moreover, of overwrapping the tied load L with the wrapping film F, as a film sheet S.

Various modifications may be made in the improved apparatus described above without departing from the scope and spirit of this invention.

We claim:

1. Apparatus for wrapping a pallet load, which is shaped generally as a rectangular solid having vertical sides and upper edges defining upper corners and lower edges defining lower corners, with a wrapping film, which is applied selectively as a film rope or as a film sheet, the apparatus comprising (a) means for supporting the pallet load in an elevated position, in which each such corner of the pallet load is exposed, (b) a supporting structure disposed in a fixed position above the pallet load, (c) a rotary arm supported by the supporting structure and arranged to be rotatably driven about a vertical axis extending through the pallet load, the rotary arm being disposed above the pallet load in any rotated position of the rotary arm, (d) an upright member depending from the rotary arm so as to be outwardly spaced from the pallet load in any rotated position of the rotary arm, (e) a carriage mounted to the upright member and arranged to be selectively driven in an upward direction along the upright member and in a downward direction along the upright member, (f) means for driving the rotary arm rotatably about the vertical axis in such manner that the upright member sweeps a cylindrical path around the pallet load, (g) means for driving the carriage selectively in an upward direction along the upright member and in a downward direction along the upright member, (h) means for dispensing a wrapping film from the carriage selectively as a film rope, in which the wrapping film is bunched into a rope-like configuration, and as a film sheet, in which the wrapping film remains substantially at full width, (i) means mounted on said carriage including a rope guide moveable between an extended position over said upper edges and below said lower edges and a retracted position away from said vertical sides for guiding the film rope selectively so as to guide the film rope across the edges defining each of the upper and lower corners of the pallet load as the rotary arm is driven rotatably with the carriage at a suitable position along the upright member in the extended position of the rope guide and so as to avoid interference between the rope guide and the pallet load as the carriage is driven in either direction along the upright member in the retracted position of the rope guide, and (j) means for moving the rope guide selectively between the extended position and the retracted position.

2. The apparatus of claim 1 wherein the rope guide comprises a lever, which is mounted pivotally to the carriage and which is pivotable selectively between a first position corresponding to the extended position of the rope guide and a second position corresponding to the retracted position of the rope guide, and wherein the rope guide comprises a hook, which is integral with the lever and through which the wrapping film passes when dispensed as a film rope.

3. The apparatus of claim 1 wherein the rope guide comprises a lever, which is mounted pivotally to the carriage and which is pivotable selectively among a first, extended position, a second, partly retracted position, and a third, fully retracted position, in which the lever is disposed so as to avoid interference with the wrapping film when dispensed as a film sheet, and wherein the rope guide comprises a hook, which is integral with the lever and through which the wrapping film passes when dispensed as a film rope.

4. The apparatus of claim 2 comprising means for preventing the carriage-driving means from driving the carriage in either direction along the upright member whenever the lever is in the first position.

5. The apparatus of claim 3 comprising means for preventing the carriage-driving means from driving the carriage in either direction along the upright member whenever the lever is in the first position.

6. The apparatus of claim 3 wherein the hook constitutes means for engaging the film rope automatically when the lever is pivoted from the third, fully retracted position into the second, partly retracted position, for retaining the film rope during pivotal movement of the lever in either direction between the second, partly retracted position and the first, extended position, and for releasing the film rope automatically upon pivotal movement of the lever from the second, partly retracted position into the third, fully retracted position.

7. Apparatus for wrapping a load, which has vertical sides and upper and lower ends defining edges of the load, with a wrapping film, which is applied as a film rope, the apparatus comprising (a) means for supporting the load in an elevated position, in which each edge defined by the upper and lower ends of the load is exposed, (b) a supporting structure disposed in a fixed position above the load, (c) a rotary arm supported by the supporting structure and arranged to be rotatably driven about a vertical axis, the rotary arm being disposed above the load in any rotated position of the rotary arm, (d) an upright member depending from the rotary arm so as to be outwardly spaced from the load in any rotated position of the rotary arm, (e) a carriage mounted to the upright member and arranged to be selectively driven in an upward direction along the upright member and in a downward direction along the upright member, (f) means for driving the rotary arm rotatably about the vertical axis in such manner that the upright member sweeps a cylindrical path around the load, (g) means for driving the carriage selectively in an upward direction along the upright member and in a downward direction along the upright member, (h) means for dispensing a wrapping film from the carriage as a film rope, in which the wrapping film is bunched into a rope-like configuration, (i) means mounted on said carriage including a rope guide moveable between an extended position above and across the upper end of the load and below and across the lower end of the load and a retracted position away from said vertical sides for guiding the film rope selectively so as to guide the film rope above and across the upper end of the load and below and across the lower end of the load as the rotary arm is driven rotatably with the carriage at stationary positions relative to the upright member in the extended position of the rope guide and so as to avoid interference between the rope guide and the pallet load as the carriage is driven in either direction along the upright member in the retracted position of the rope guide, and (j) means for moving the rope guide selectively between the extended position and the retracted position.

8. The apparatus of claim 7 wherein the rope guide comprises a lever, which is mounted pivotally to the carriage and which is pivotable selectively between a first position corresponding to the extended position of the rope guide and a second position corresponding to the retracted position of the rope guide, and wherein the rope guide comprises a hook, which is integral with the lever and through which the film rope passes as the film rope is dispensed by the dispensing means.

9. The apparatus of claim 8 comprising means for preventing the carriage-driving means from driving the carriage in either direction along the upright member whenever the lever is in the first position.

* * * * *